US007028828B2

(12) United States Patent
Dombek et al.

(10) Patent No.: US 7,028,828 B2
(45) Date of Patent: Apr. 18, 2006

(54) MAGAZINE FOR ROD-SHAPED ARTICLES, IN PARTICULAR FILTER RODS, IN THE TOBACCO-PROCESSING INDUSTRY

(75) Inventors: Manfred Dombek, Dassendorf (DE); Michael Haul, Kröppelshagen (DE)

(73) Assignee: Hauni Maschinenbau AG, Hamburg (DE)

( * ) Notice: Subject to any disclaimer, the term of this patent is extended or adjusted under 35 U.S.C. 154(b) by 175 days.

(21) Appl. No.: 10/289,424

(22) Filed: Nov. 7, 2002

(65) Prior Publication Data

US 2003/0091412 A1 May 15, 2003

(30) Foreign Application Priority Data

Nov. 9, 2001 (DE) ..... 101 54 746

(51) Int. Cl.
*B65G 43/18* (2006.01)

(52) U.S. Cl. ..... 198/347.2; 198/347.3

(58) Field of Classification Search ..... 198/347.2, 198/347.3; 131/282
See application file for complete search history.

(56) References Cited

U.S. PATENT DOCUMENTS 2,997,828 A * 8/1961 Ahlbor ..... 53/505
4,222,477 A * 9/1980 Molins et al. ..... 198/347.3
4,273,233 A * 6/1981 Hinchcliffe et al. ..... 198/347.3
4,352,604 A * 10/1982 Carascon et al. ..... 406/28
4,420,073 A * 12/1983 Hausler et al. ..... 198/347.2
4,555,011 A * 11/1985 Brown ..... 198/444
4,795,019 A * 1/1989 Spada et al. ..... 198/347.2
4,795,020 A * 1/1989 Carter et al. ..... 198/369.7
4,813,527 A * 3/1989 Carter ..... 198/347.1
5,452,984 A 9/1995 Porter et al.
6,065,358 A * 5/2000 Shepherd ..... 73/865.8

FOREIGN PATENT DOCUMENTS

| | | |
|---|---|---|
| DE | 35 38 660 C2 | 5/1986 |
| FR | 1 545 986 A | 11/1968 |
| GB | 1 501 535 A | 2/1978 |
| GB | 2 132 969 A | 7/1984 |

* cited by examiner

*Primary Examiner*—Thomas J Brahan
(74) *Attorney, Agent, or Firm*—Venable LLP; Robert Kinberg

(57) ABSTRACT

A magazine for rod-shaped articles comprises a storage unit having at least one inlet for receiving at least one of the articles supplied to the storage unit and at least one outlet for discharging at least one of the articles positioned in the storage unit. A variable length belt element disposed in the storage unit has a length which defines a fixed storage unit for accommodating a predetermined number of articles. The length of the belt element is expandable for defining a working storage unit, the volume of which can be changed with the expansion of the belt element.

18 Claims, 2 Drawing Sheets

MAGAZINE FOR ROD-SHAPED ARTICLES, IN PARTICULAR FILTER RODS, IN THE TOBACCO-PROCESSING INDUSTRY

CROSS-REFERENCE TO RELATED APPLICATION

This application claims the priority of German Patent Application No. 101 54 746.3 filed on Nov. 9, 2001, the disclosure of which, together with the disclosure of each and every U.S. and foreign patent and patent application mentioned below, is incorporated herein by reference.

BACKGROUND OF THE INVENTION

The invention relates to a magazine for rod-shaped articles, in particular filter rods, in the tobacco-processing industry. The magazine comprises a storage unit or reservoir having at least one inlet for accepting at least one article that is supplied to the storage unit, as well as at least one outlet for discharging at least one article positioned in the storage unit. The invention furthermore comprises a machine for the tobacco-processing industry, used in particular for producing rod-shaped articles and especially cigarettes or filters.

In addition to filter rods, the term "rod-shaped articles in the tobacco-processing industry" is understood herein to mean, for example, cigarettes, cigarillos or cigars with and without filters, for which the invention equally can be used.

During the production or processing of rod-shaped articles in the tobacco-processing industry, these rod-shaped articles or parts thereof are conveyed via pneumatic conveyor pipelines from a production machine to a machine for further processing. Thus, the filter rods are transported via a conveyor pipeline to a storage magazine, for example one belonging to a filter-attachment machine.

German Patent 35 38 660 C2 discloses a storage magazine for a filter-attachment machine where the filter rods are conveyed with transverse positioned axes through a chute into a magazine. The filter rods are subsequently supplied from this magazine to the filter-attachment machine. This machine has the disadvantage that the filter rods are supplied counter to the force of the weight of the filter rods already present in the magazine since the filter rods must be pushed from the bottom into the magazine. The impact-sensitive filter rods that are supplied can be damaged or even crushed during the insertion into the magazine.

U.S. Pat. No. 5,452,984 discloses a tray that is filled via an opening in a filling device. During the filling of the tray, the filter rods are filled into an expanding, flexible belt that encloses the filter rods inside the tray. One end of the belt is attached to the opening and the other end is wound around a drum. To remove the filter rods from the tray, the tray is guided to a removal station in which the filter rods are emptied out through the same opening used for filling in the rods. In the process, the belt enclosing the filter rods inside the tray is wound up again.

SUMMARY OF THE INVENTION

Starting with the aforementioned prior art, it is the object of the present invention to provide a magazine which ensures that the rod-shaped articles are subjected to low mechanical stress during the insertion into the magazine and during the operation. The magazine should furthermore permit a rapid replacement of cigarette filters, for example, in case of a brand change.

The above and other objects are achieved according to the invention by the provision of a magazine for rod-shaped articles, comprising: a storage unit having at least one inlet for receiving at least one of the articles supplied to the storage unit and at least one outlet for discharging at least one of the articles positioned in the storage unit; and a variable length belt element disposed in the storage unit and having a length defining a fixed storage unit for accommodating a predetermined number of articles, the length of the belt element being expandable for defining a working storage unit the volume of which can be changed with the belt element.

The fixed storage unit functions as a permanently existing article or filter supply to prevent articles from being deposited crosswise either behind or at the receiving station. In addition, the fixed storage unit keeps the outlet supplied. As a result of the belt element, the arrangement of articles is completely enclosed during the filling and emptying of the magazine, so that no articles are positioned crosswise in the article packet. Depending on the article filling level in the storage unit, the length or size of the belt element surrounding the articles can be changed, thus permitting a corresponding adjustment of the storage unit size during the magazine operation.

The variability of the working storage unit and the insertion of the articles in the upper region of the working storage unit furthermore permit a soft insertion of the rod-shaped articles because the working storage unit expands as the number of articles in the working storage unit increases, thus resulting in noticeably less damage to the articles. In case of a change in the article brand, the operating personnel can manually fill the fixed storage unit within a short time with different articles or filter rods. In addition, the mechanical stress on the articles in the fixed storage unit is also low. On the whole, an extremely simple, favorable and compact design is achieved for the magazine, thus resulting in an easy first-time filling, e.g. during a brand change, and a careful handling of the articles in the storage unit.

It is furthermore advantageous that the belt element length remains the same during the filling of the fixed storage unit. As a result, the fixed storage unit volume is defined precisely and thus accommodates a predetermined minimum number of articles. The fixed storage unit permits an optimum use of the overall storage volume since the fixed storage unit volume is determined by the fact that the size and/or length of the otherwise variable belt element can no longer be adjusted. That is the case, for example, if the belt element has reached its minimum length.

According to one exemplary embodiment of the invention, the length of the belt element can be changed during the filling of the working storage unit. The term "belt element" is understood to mean in particular one section or that section of a belt, which surrounds the articles, e.g. the filter rods, and by means of which the fixed storage unit or the working storage unit can be configured. Since the working storage unit has a variable design, the length of the belt element changes as well while, on the other hand, the total length of the belt remains constant. The belt element length is varied during the filling and emptying of the working storage unit to make possible a careful handling of the articles, so that a compact arrangement of the articles without transverse positioning in the working storage unit is achieved.

The careful handling of the articles is furthermore improved with an elastic and/or flexible belt element. As a result, the belt element can fit itself well against the outer layer and/or the surface of the article arrangement.

In addition, it is advantageous when one end of the belt element is arranged inside the storage unit, particularly on the bottom of the storage unit, since this means that the articles in the complete storage unit are surrounded and handled carefully.

To achieve a careful handling of all articles in a storage unit with extremely large volume, it is preferable that the end of the belt element is arranged inside the storage unit so as to be movable, in particular in a linear direction. In addition, the working storage unit volume can be influenced and varied due to the mobility of the attachment point (end of the belt element). The mechanical stress on the articles is also reduced with this measure if, for example, the articles are packed densely owing to a fixed storage volume.

The belt element of one advantageous modification of the invention can be moved with a transport device, in particular a conveyor belt. The end of the belt element is attached to the transport device, such that it can be moved. The transport device at the same time makes it possible to move along the articles positioned on the transport device. Thus, with a larger overall storage unit a larger number of articles can be handled carefully in the working storage unit.

The end of the belt element can be guided easily, for example, when the transport device can be controlled and/or adjusted with a control and/or adjustment unit.

To achieve an arrangement of the articles without gaps in the working storage unit, it is advantageous when the belt element is tensioned with a tensioning device, particularly a motor or block and pulley. The tensioning device ensures that the belt element makes contact over its complete length with the outside of the articles arranged in the storage unit. In addition, this prevents bulges and indentations from forming in the belt element and in the working storage unit.

The forces for adjusting the belt element can be variable or constant forces, provided the tensioning device can advantageously be controlled or adjusted.

The belt element furthermore is preferably designed to have the shortest possible length or size for forming the fixed storage unit.

The filling level for the storage unit or the working storage unit can be monitored reliably when at least one sensor is provided for the filling and/or emptying of the storage unit.

According to another advantageous modification, the sensor is connected to the transport device and/or the tensioning device. Depending on the filling level and the treatment of the article in the storage unit, a particularly careful storage of the articles can thus be achieved. In addition, the filters can also be stored, for example, based on the filter type.

One alternative embodiment also reduces the force for inserting an article into the storage unit, provided the inlet for feeding the article into the storage unit is arranged in the upper region of the storage unit filling level and/or in the upper region of the working storage unit.

A safe and careful feeding of articles can be achieved when the inlet for inserting the articles is preferably designed to be on the side. On the whole, the mechanical stress on the fragile articles is thus reduced considerably.

The object is furthermore solved with a machine in the tobacco-processing industry, in particular a machine for producing rod-shaped articles and especially cigarettes or filters, which machine is embodied with the above-described magazine.

BRIEF DESCRIPTION OF THE DRAWINGS

In the following, the invention is described with exemplary embodiments with reference to the drawings, without restricting the general inventive idea.

DETAILED DESCRIPTION OF THE INVENTION

Figure 1:
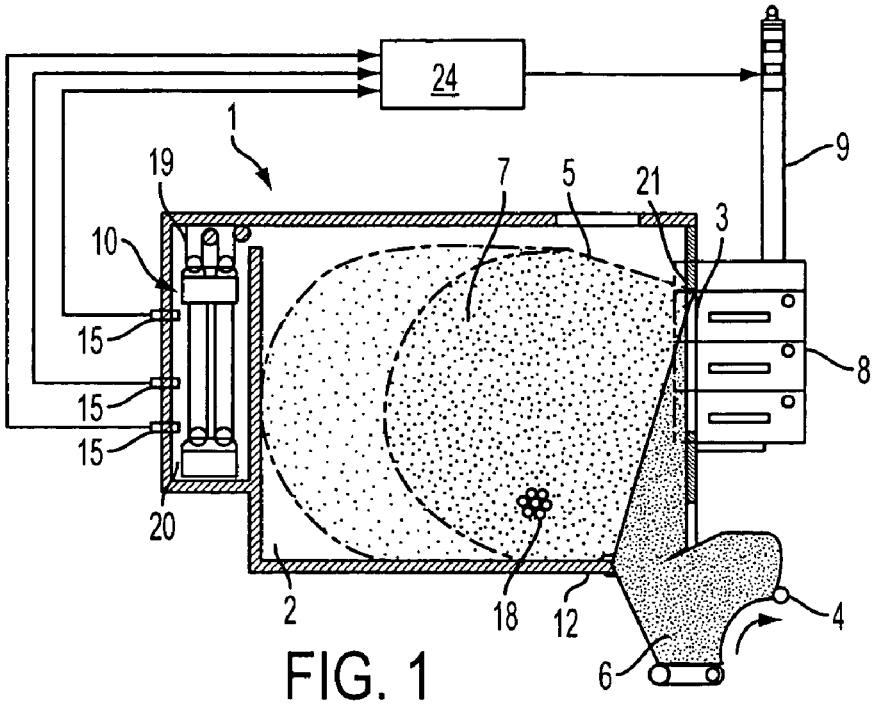
FIG. 1 is a cross-sectional view of a magazine according to the invention.

In the following Figures, respectively identical or corresponding parts are given the same reference numerals and will not be introduced again.

FIG. 1 shows a cross section through a magazine 1 provided with a storage unit 2. The magazine 1 additionally comprises a chamber 20 that is spatially separated from the storage space 2 and accommodates a tensioning device 10 that will be described below.

In addition, a filter-feeding device 8 is arranged on one side of the magazine 1 and/or the storage unit 2. This filter-feeding device is supplied via a connected conveyor pipeline 9 with rod-shaped articles, e.g., filter rods from a filter supply station. The supplied filter rods are inserted with lateral axial positioning and via inlets 3 of the filter-feeding device 8 into the storage unit 2. A system including a filter feeding device and a filter sending station that may be used with the present invention is manufactured and sold by the assignee of the present application under the name FILTROMAT.

One end of a belt 19 that includes a belt element 5 is locally secured to the bottom of the storage unit 2 at a securing point 12.

With the aid of several deflection devices and guides (which are not described in further detail herein), the other end of the belt 19 is arranged inside the chamber 20 that is adjacent to the storage unit 2. The belt 19 is kept tensioned by means of a tensioning device formed by a block and pulley 10. One section of the belt 19 is held between the securing point 12 and a deflection point 21. The section of belt 19 between the points 12 and 21 is referred to as the belt element 5. The length of the belt element 5 in the storage unit 2 varies, based on the filling of the storage unit 2 with filter rods.

The belt element 5 held between the securing point 12 and the deflection point 21 divides the storage unit 2 into a fixed storage unit 6 and a working storage unit 7. When filling the storage unit 2 with filter rods, the fixed storage unit 6 is initially filled with the filter rods. Thus, the belt element 5 increases in length only after the fixed storage unit 6 is filled, as a result of the continuous filling with filter rods, thus forming the working storage unit 7. The belt element 5, originally tensioned to be straight, subsequently becomes increasingly more round in shape.

To allow for a secure start-up of the machine, e.g., a filter-attachment machine during a change in the cigarette brand, which also involves a change in the filter type, the fixed storage unit 6 as a rule is filled manually ahead of time. The filling of the fixed storage unit 6 prevents the crosswise positioning of filter rods to be removed, for example with a removal drum via the outlet 4 on the fixed storage unit 6.

As a result of inserting the filter rods from the side via the inlet 3 on the filter-feeding device 8, in the upper region of the storage unit 2, the mechanical stress on the inserted filter rods is reduced considerably. This is due to the fact that owing to the variable length of the belt element 5, the working storage unit 7 can be adjusted continuously during the machine operation based on the filling level and the filter type. A compact arrangement of the filters thus results in the working storage unit 7, as is indicated with the filter packet 18 in the working storage unit 7. Experiments have shown that the filter rods in the working storage unit 7 move while the filling level increases. However, their position relative to each other changes only slightly or hardly, thus reducing the mechanical stress. In particular, it has turned out that the filter packet 18 carries out a type of rolling movement. That is to say, the filter rods in the magazine and/or the working storage unit 7 have not experienced any essential change in the position relative to each other.

Light barriers 15 for polling the magazine filling level are furthermore arranged inside the chamber 20 for the tensioning device 10. These light barriers send signals based on the height of the weight(s) of the block and pulley to a machine controller 24 controlling the feeding of filters via the conveyor pipeline 9 and feeding device 8 to the magazine 1.

Depending on the filter type, different types of weights can be used on the block and pulley 10.

Figure 2:
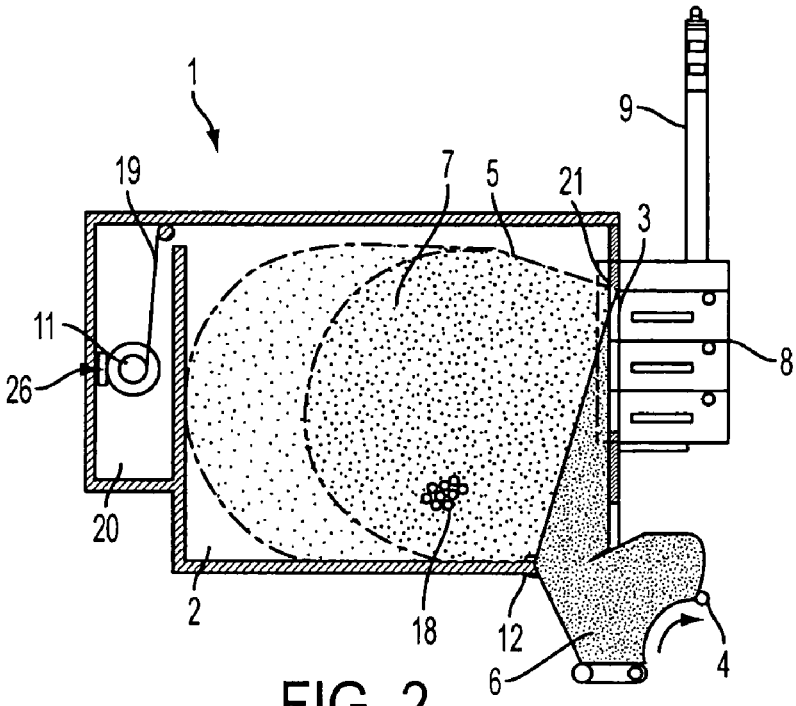
FIG. 2 is an alternative embodiment of a magazine shown in FIG. 1.

FIG. 2 discloses an alternative embodiment of the magazine 1, which uses in place of the block and pulley 10 arrangement a motor 11, which exerts a defined, predetermined force onto the belt 19 and/or the belt element 5 with a torque-controlled servomotor. This force can be determined in dependence on the filter type and the magazine filling state of the working storage unit 7. The state of the filling level can be determined with an incremental measuring method at the motor 11. The filter packet 18 can furthermore be moved via the belt 19 and by altering the torque with the aid of a respective control and adjustment unit 26 built into the motor 11.

Figure 3:
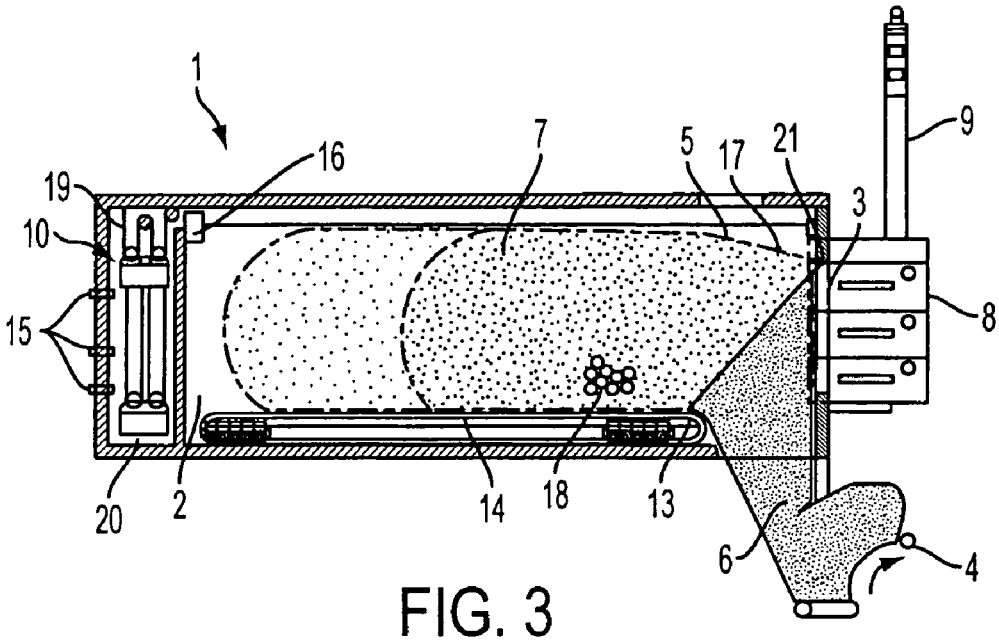
FIG. 3 is another alternative embodiment of the magazine shown FIG. 1.

The alternative embodiment of a magazine 1, shown in FIG. 3, makes it possible to fill a larger storage unit space 2. In place of a fixed securing point 12, the one end of the belt 19 and/or the belt element 5 is arranged to be movable on a conveyor belt 14.

A light barrier 16, arranged alongside the storage unit 2, is used to control the conveyor belt 14 during the filling of the working storage unit 7. The light barrier 16 polls the height of the filter rods in the working storage unit 7. Once a specific height and/or a predetermined level are reached, the conveyor belt moves to the left, so that the height inside the working storage unit 7 is reduced. The volume of the working storage unit 7 is increased as a result of the movement of conveyor belt 14. While the working storage unit 7 is emptied, the insertion region near the filter-feeding device 8 is polled with the aid of another sensor 17 that is arranged crosswise to the first sensor 16. As soon as empty spaces are discovered in the working storage unit 7 or the filling level is reduced, the conveyor belt 14 is moved back (to the right). A corresponding control or adjustment unit 28 is provided for controlling and/or regulating the conveyor belt 14 in response to inputs from the light barrier 16 and the sensor 17. The advantage of the magazine 1 shown in FIG. 3 is that the storage volume inside the storage unit 2 can be expanded or reduced by extending the working storage unit 7.

Figure 4:
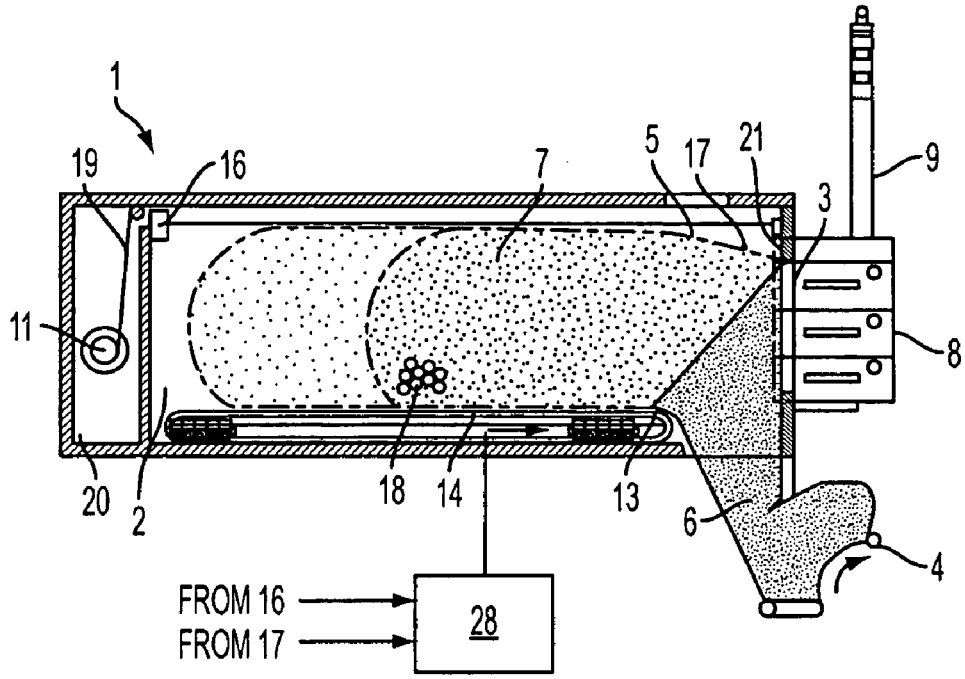
FIG. 4 is a further variant of the magazine shown in FIG. 3.

A block and pulley arrangement 10 (FIG. 3) as well as an incremental motor 11 (FIG. 4) can be used as a tensioning device for the belt 19.

The invention permits the careful storage inside a magazine of sensitive articles in the tobacco-processing industry (e.g. filter rods). The magazine according to the invention can be used for a filter-attachment machine as well as a dual hopper.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A magazine for rod-shaped articles, comprising:

a storage unit having at least one inlet for receiving at least one of the articles supplied to the storage unit and at least one outlet for discharging at least one of the articles positioned in the storage unit; and a belt having a variable length belt element disposed in the storage unit, the variable length belt element having an initial length defining a fixed storage area in the storage unit for accommodating a predetermined number of articles, the length of the variable length belt element disposed in the storage unit being expandable from the initial length to define a working storage area in the storage unit having a volume which is a function of the length of the variable length belt element; and a controlled motor coupled to the variable length belt element to exert a predetermined force on the variable length belt element.

2. The magazine according to claim 1, wherein the length of the belt element remains fixed at the initial length while the fixed storage area is formed.

3. The magazine according to claim 1, wherein the length of the belt element is changeable during the filling of the working storage area.

4. The magazine according to claim 1, wherein the belt element is at least one of elastic or flexible.

5. The magazine according to claim 1, wherein one end of the belt element is attached at a location inside the storage unit.

6. The magazine according to claim 5, wherein the one end of the belt element is attached at a location on the bottom of the storage unit.

7. The magazine according to claim 5, further comprising means for moving the one end of the belt element inside the storage unit.

8. The magazine according to claim 7, wherein the means for moving is for moving the one end of the belt element in a linear direction.

9. The magazine according to claim 8, wherein the means for moving comprises a transport device for moving the end of the belt element.

10. The magazine according to claim 9, wherein the transport device comprises a conveyor belt.

11. The magazine according to claim 10, and further comprising a controller for adjusting the transport device.

12. The magazine according to claim 5, and further including a transport device for moving the end of the belt element in a linear direction inside the storage unit, and wherein the sensor is coupled the transport device.

13. The magazine according to claim 1, and further comprising an adjustment device for adjusting the torque of the controlled motor.

14. The magazine according to claim 1, wherein the belt element has the shortest length when forming the fixed storage area.

15. The magazine according to claim 1, and further comprising at least one sensor for monitoring at least one of the filling and emptying of the storage unit.

16. The magazine according to claim 1, wherein the inlet for feeding the articles into the storage unit is arranged in an upper filling level region of the storage unit.

17. The magazine according to claim 1, wherein the inlet is arranged for inserting the articles into the storage unit from the side.

18. A machine for producing rod-shaped articles in the tobacco-processing industry comprising a magazine according to claim 1.

* * * * *